US010145548B2

(12) United States Patent
Chen

(10) Patent No.: US 10,145,548 B2
(45) Date of Patent: Dec. 4, 2018

(54) MOTION SENSING LIGHTING DEVICE

(71) Applicant: Chia-Teh Chen, Taipei (TW)

(72) Inventor: Chia-Teh Chen, Taipei (TW)

( * ) Notice: Subject to any disclaimer, the term of this patent is extended or adjusted under 35 U.S.C. 154(b) by 275 days.

(21) Appl. No.: 14/981,883

(22) Filed: Dec. 28, 2015

(65) Prior Publication Data

US 2017/0184293 A1 Jun. 29, 2017

(51) Int. Cl.

| | |
|---|---|
| ***F21V 1/00*** | (2006.01) |
| ***F21V 23/04*** | (2006.01) |
| ***F21S 8/00*** | (2006.01) |
| ***F21V 21/30*** | (2006.01) |
| *F21W 131/10* | (2006.01) |
| *F21Y 115/10* | (2016.01) |

(52) U.S. Cl.
CPC ..... *F21V 23/0471* (2013.01); *F21S 8/033* (2013.01); *F21V 21/30* (2013.01); *F21W 2131/10* (2013.01); *F21Y 2115/10* (2016.08)

(58) Field of Classification Search
CPC ..... F21V 23/0471; F21V 1/02; F21V 7/04; F21V 17/101; F21V 17/12; F21V 21/14; F21V 23/002; F21V 31/005; F21V 21/30; F21V 14/02; F21V 19/02; F21S 8/033; F21Y 2115/10; F21W 2131/10
USPC ..... 362/235
See application file for complete search history.

(56) References Cited

U.S. PATENT DOCUMENTS

2007/0109781 A1* 5/2007 Chiu ..... F21V 21/15 362/253
2009/0251058 A1* 10/2009 Chen ..... H05B 37/0218 315/159

* cited by examiner

*Primary Examiner* — Anh Mai
*Assistant Examiner* — Meghan Ulanday
(74) *Attorney, Agent, or Firm* — Li & Cai Intellectual Property (USA) Office

(57) ABSTRACT

A motion sensing lighting device includes a base seat, an illuminating assembly, and a sensing component. The base seat has a pivotal portion. The illuminating assembly includes a pair of illumination lamps. The illuminating assembly has an adapter module rotatably mounted to the pivotal portion, and a pair of illumination lamps. The adapter module is pivotally connected to the pivotal portion. The pair of illumination lamps are rotatably arranged at two sides of the adapter module. The sensing component is pivotally connected to the pivotal portion and is selectively used to start the illuminating assembly.

17 Claims, 11 Drawing Sheets

MOTION SENSING LIGHTING DEVICE

BACKGROUND OF THE INVENTION

1. Field of the Invention

The instant disclosure is related to a motion sensing lighting device, or a security light. In particular, the instant disclosure relates to a lighting device which can provide light when an object is sensed.

2. Description of Related Art

Energy Saving and Carbon Reduction are common goals. A motion sensing lighting device can be automatically turned on to provide light when sensing an object, so that it can reduce a considerable power bill and elongate a life time of the light source. In addition, the motion sensing lighting device also provides a function of anti-theft for a safe place to reside.

The motion sensing lighting device preferably should satisfy requirements of adjustable detecting realm, and adjustable lighting angles. For a wider illuminating angle, the motion sensing lighting device is equipped with two and more lights. Each light is connected to the base seat by an axle, but the assembling is usually complex. Further, as the motion sensing lighting device is mostly mounted outside, the axle may increase the risk of moisture entering the base seat.

Moreover, the lighting devices also increase the assembly procedures. Therefore, how to reduce the assembly procedures and simplify the assembly time and labor are problems that need to be considered.

SUMMARY OF THE INVENTION

It is one objective of this invention to provide a motion sensing lighting device, which has an illuminating light connected to a base seat by an axle, and to fulfill a wider illuminating angle. In addition, this invention also simplifies the assembling steps.

In order to achieve the above objectives, according to one exemplary embodiment of the instant disclosure, the instant disclosure provides a motion sensing lighting device, which includes a base seat, and an illuminating assembly. The base seat has a pivotal portion. The illuminating assembly includes an adapter module rotatably connected to the pivotal portion, and a pair of illumination lamps, the adapter module pivotally connected to the pivotal portion. The pair of illumination lamps are rotatably arranged at two sides of the adapter module.

According to one embodiment of the instant disclosure, the adapter module has two ends extended forward to connect a central component, and a hinge module is arranged between one side of the illumination lamp and one side of the central component. The pair of illumination lamps is rotatably connected to two sides of the central component by the hinge module, respectively.

According to one embodiment of the instant disclosure, two ends of the adapter module respectively have a hinge module, the pair of illumination lamps are rotatably connected to the pair of hinge modules, respectively.

Thus, the instant disclosure has advantages as follows. The illuminating assembly of the instant disclosure is pivotally connected to the base seat by a single pivotal axis, so that the lighting angle is adjustable, and can fulfill a requirement of enlarging the lighting. This embodiment can be conveniently adjusted according the requirement of lighting.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

Figure 1:
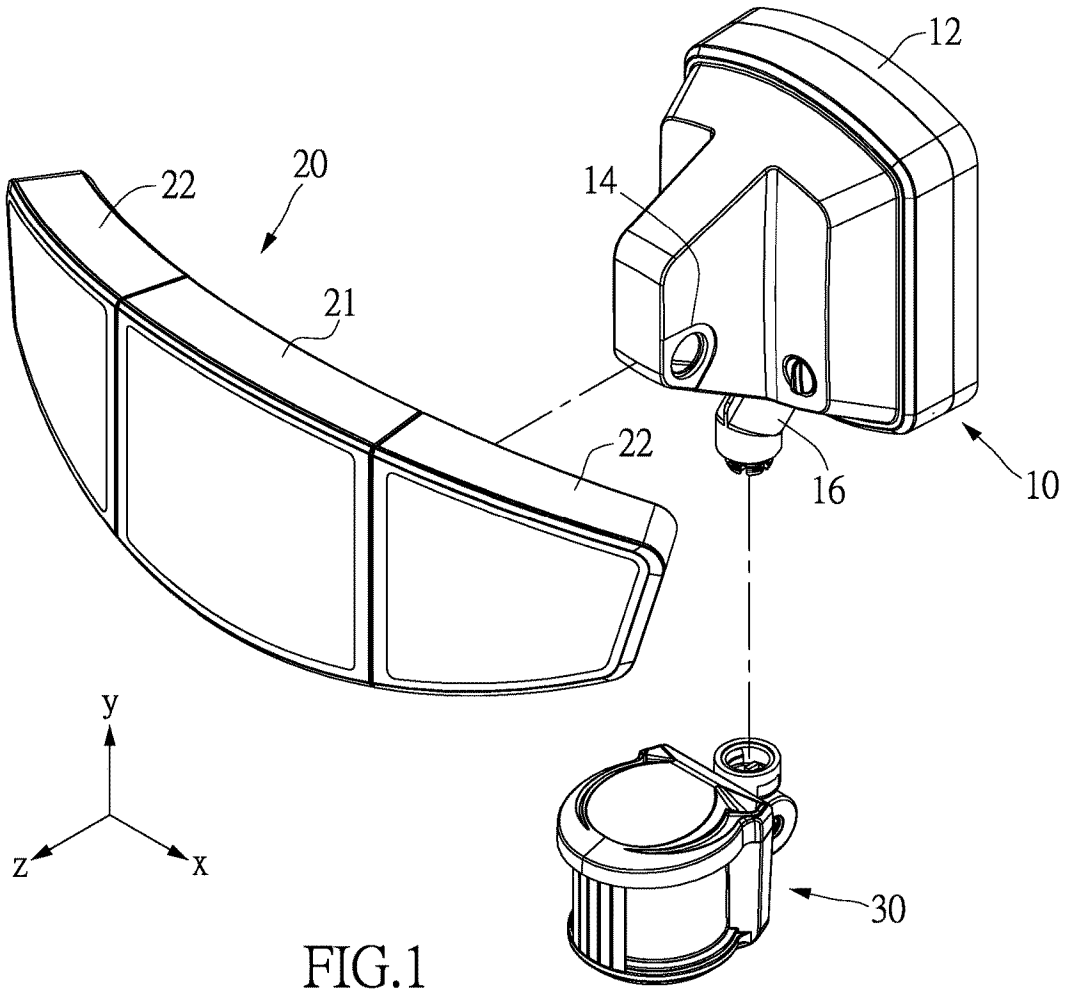
FIG. 1 is an exploded perspective view of a motion sensing lighting device of the instant disclosure.
Figure 2:
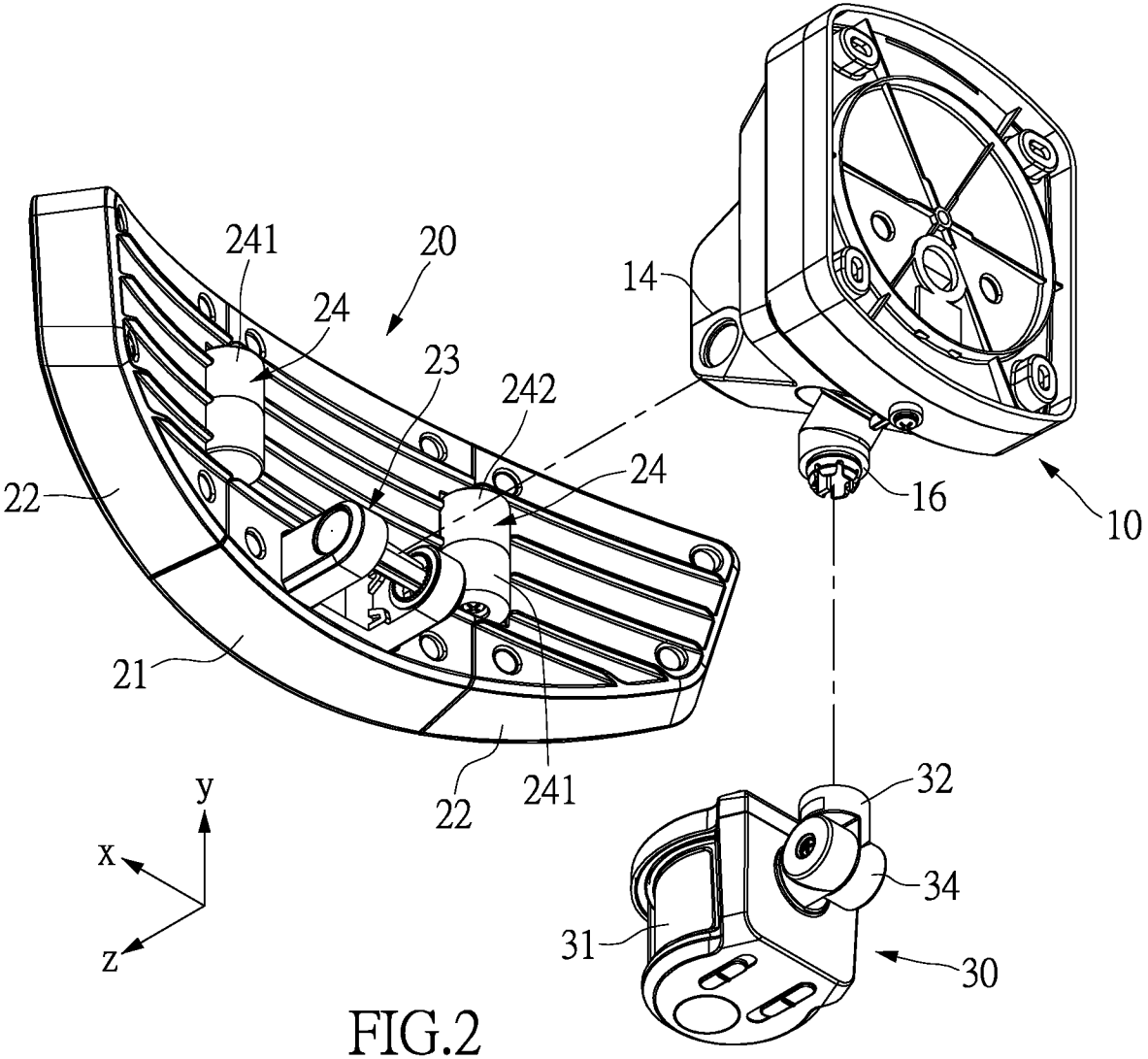
FIG. 2 is another exploded perspective view of the motion sensing lighting device of the instant disclosure.

Refer to FIG. 1 and FIG. 2, which are exploded perspective views of a motion sensing lighting device of the instant disclosure. The instant disclosure provides a motion sensing lighting device, which includes a base seat 10, an illuminating assembly 20, and a sensing component 30.

The base seat 10 has a mounting portion 12, a pivotal portion 14 extending from the mounting portion 12, and a connecting axle 16 arranged under the pivotal portion 14. The mounting portion 12 is used to receive a controlling element for adjustment and controlling, for example light time and light intensity . . . etc. The mounting portion 12 can be mounted on a wall.

The illuminating assembly 20 has a front lamp 21 as a central component and at least one illumination lamp 22. In this embodiment, there are two symmetrical illumination lamps 22 oppositely arranged at two sides of the front lamp 21, but it is not limited thereto. For example, a top edge of the front lamp 21 can be connected with another illumination lamp. Refer to FIG. 2. The illumination lamp 22 has one side pivotally connected to one side of the front lamp 21. An adapter module 23 is protrudently arranged at a back of the front lamp 21. The adapter module 23 is pivotally connected to the pivotal portion 14 of the base seat 10. The adapter module 23 has two ends protruded forward to connect the central component. As shown in FIG. 1 and FIG. 2, the axes of the adapter module 23 and the pivotal portion 14 are rotated along the x-axis, so that the lighting angle of the illuminating assembly 20 can be adjusted upward or downward.

As shown in FIG. 2, the illuminating assembly 20 further includes a hinge module 24, which is connected between the front lamp 21 and the illumination lamp 22. The hinge module 24 has a first sleeve 241 and a second sleeve 242 rotatably stacked to the first sleeve 241. The first sleeve 241 has a part fixed to one side of the front lamp 21, and the second sleeve 242 has a part fixed to one side of the illumination lamp 22. Refer to FIG. 1. The rotating axis of the adapter module 23 is substantially perpendicular to the rotating axis of the hinge module 24. The axis of the hinge module 24 is rotated along the y-axis, so that the illumination lamp 22 of the illuminating assembly 20 can be adjusted toward two sides thereof to accommodate a wide range of lighting angles.

The sensing component 30 is rotatably connected to the connecting axle 16 of the base seat 10, and is to selectively switch on the illuminating assembly 20. The sensing component 30 includes a sensor 31, an erective rod 32, and a traverse rod 34. The erective rod 32 is correspondingly connected to the connecting axle 16. The traverse rod 34 is rotatably connected to the erective rod 32 along the x-axis. The erective rod 32 and the traverse rod 34 are arranged at the back of the sensor 31. The sensor 31 is used to sense an object's movement, such as an infrared sensor . . . etc. As shown in FIG. 1, the erective rod 32 of the sensing component 30 is connected to the connecting axle 16 along the y-axis, so that the sensor 31 can be adjusted to left or right to change the sensing direction. Further, the sensor 31 can be adjusted to change an angle of pitch through the traverse rod 34.

Figure 3:
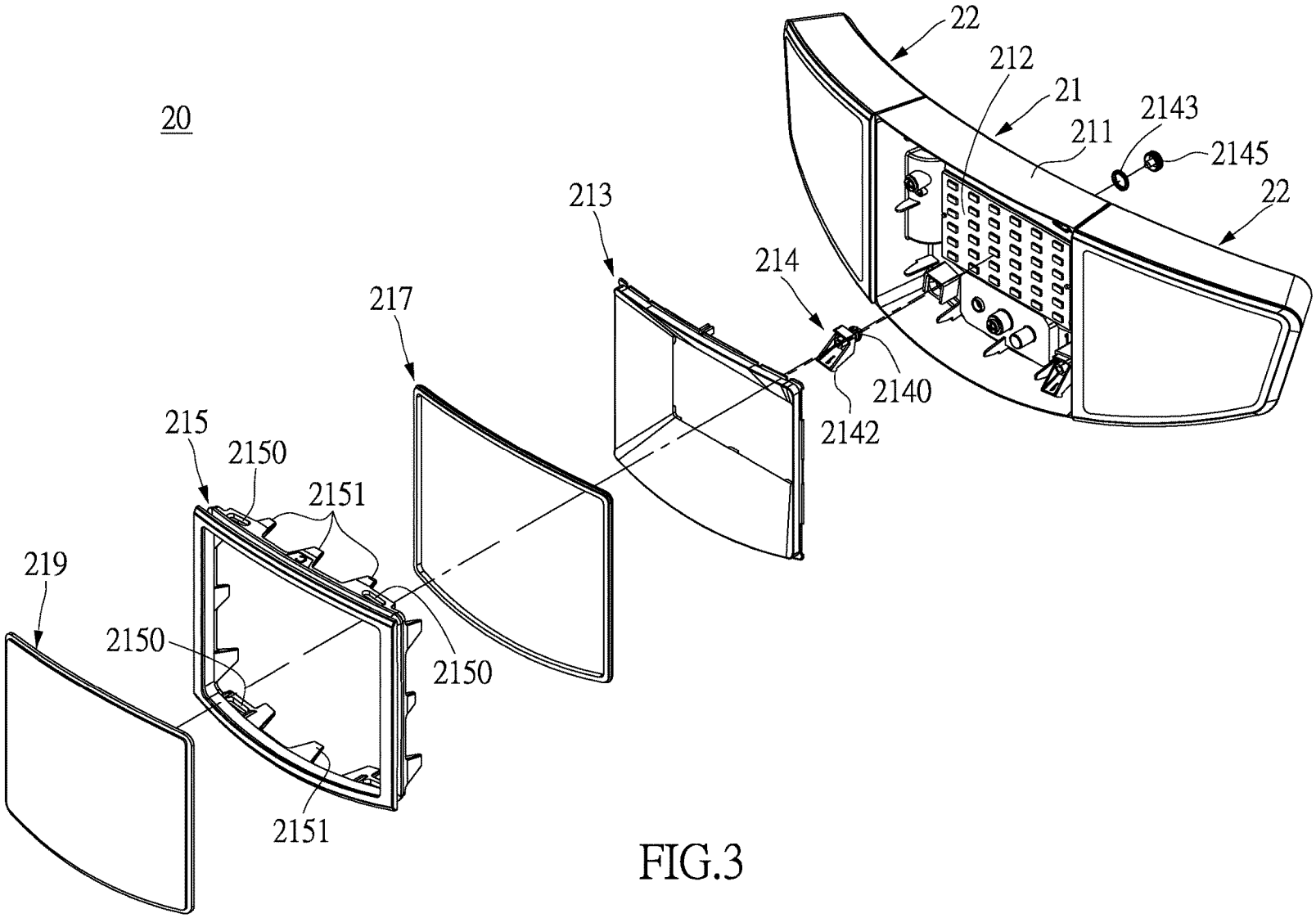
FIG. 3 is an exploded perspective view of an illuminating assembly of the motion sensing lighting device of the instant disclosure.
Figure 4:
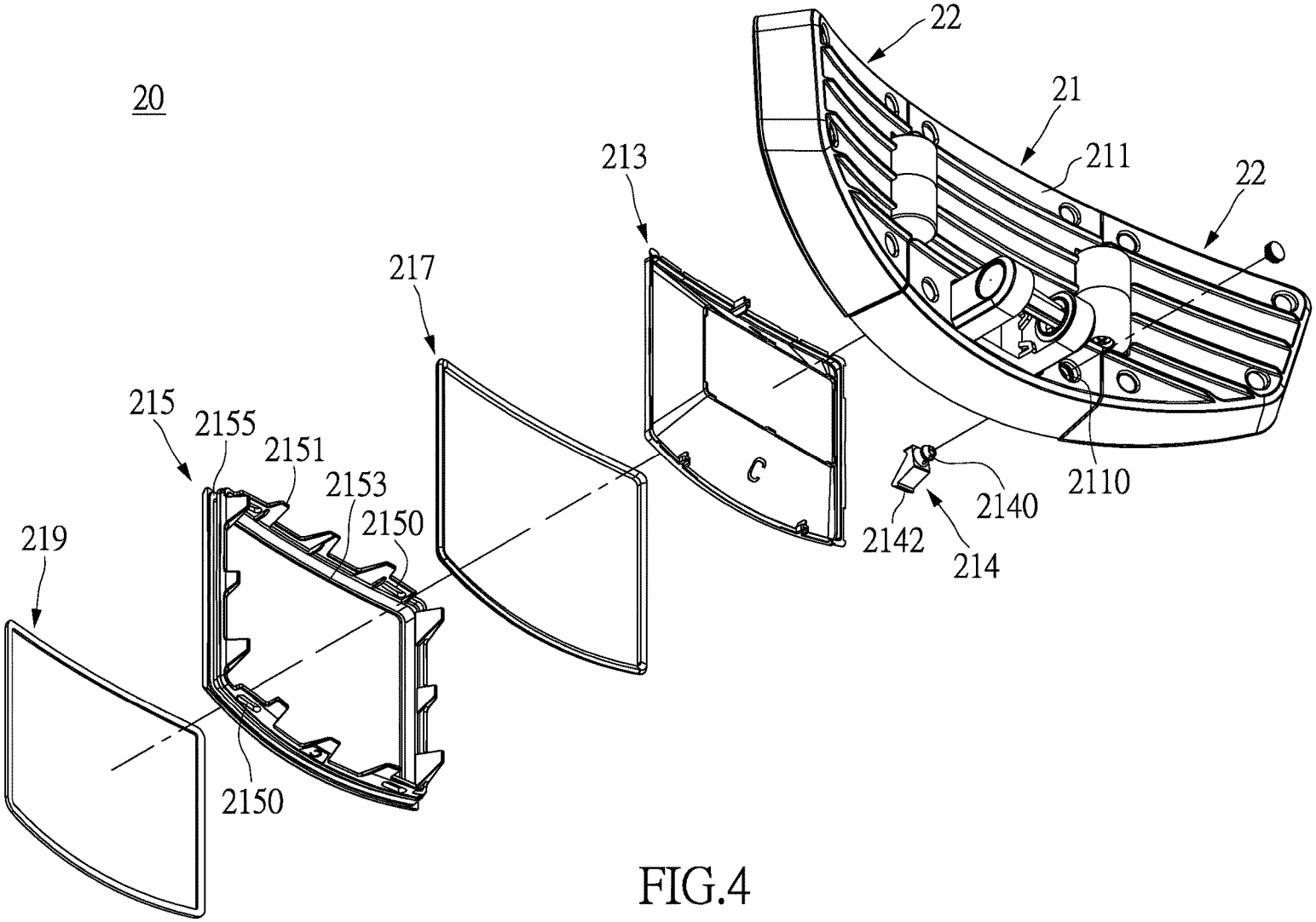
FIG. 4 is another exploded perspective view of an illuminating assembly of the motion sensing lighting device of the instant disclosure.

The elements are introduced as follows. The inner structure of the front lamp 21 of the illuminating assembly 20 is similar to the illumination lamp 22. Refer to FIG. 3 and FIG. 4, which show the exploded views of the front lamp 21. The front lamp 21 includes a dish-shaped housing 211, a lighting unit 212 fixed in the housing 211, a hollow-shaped reflector 213, a retaining frame 215 used to fix the reflector 213 to the housing 211, a sealing ring 217 surrounding the groove 2155 of the retaining frame 215, and a lampshade 219 fixed to the retaining frame 215 covering the reflector 213. In this embodiment, the lighting unit 212 is an LED light. The lampshade 219 can be adhered to the retaining frame 215. The housing 211 in this embodiment is substantially square-dish shaped. The front end of the front lamp 21 has a water-proofing function through the sealing ring 217, so that moisture can be prevented from entering into the front lamp 21 from a front opening of the housing 211.

The front lamp 21 further includes a plurality of linking units 214. The housing 211 has a plurality of engaging holes 2110 corresponding to the linking units 214. The quantity of the engaging holes 2110 corresponds to the quantity of the linking units 214. An inner edge of the retaining frame 215 has a plurality of fastening rings 2150 protruded toward the housing 211 and corresponds to the engaging holes 2110. Each of the linking units 214 has a wedging part 2140 and a fastening part 2142. The wedging parts 2140 of the linking units 214 are correspondingly engaged to the engaging holes 2110 of the housing 211. The fastening parts 2142 of the linking unit 214 are correspondingly buckled with the fastening rings 2150 of the retaining frame 215. The linking unit 214 provides a convenient assembly manner, which does not need screws or a screw driver. It only needs engagement or buckling, and the assembling of the front lamp 21 is finished.

To provide a water-proofing function, the linking unit 214 further includes a water-proof ring 2143 disposed on the wedging part 2140 which contacts a periphery of the engaging hole 2110, and an ornamental cover 2145 is fixed at an outer end of the wedging part 2140. The ornamental cover 2145 covers the engaging hole 2110 from the back of the housing 211. By the water-proof ring 2143, the back of the front lamp 21 also provides a water-proofing function, so that moisture can be prevented from entering the front lamp 21 from the back of the housing 211.

Refer to FIG. 4. The inner edge of the retaining frame 215 further has an inner rim 2153, and a plurality of snap taps 2151 protruded toward the housing 211. The inner rim 2153 blocks the reflector 213. The snap taps 2151 are abutted against a periphery of the reflector 213, and contact an inner surface of the housing 211.

Figure 5:
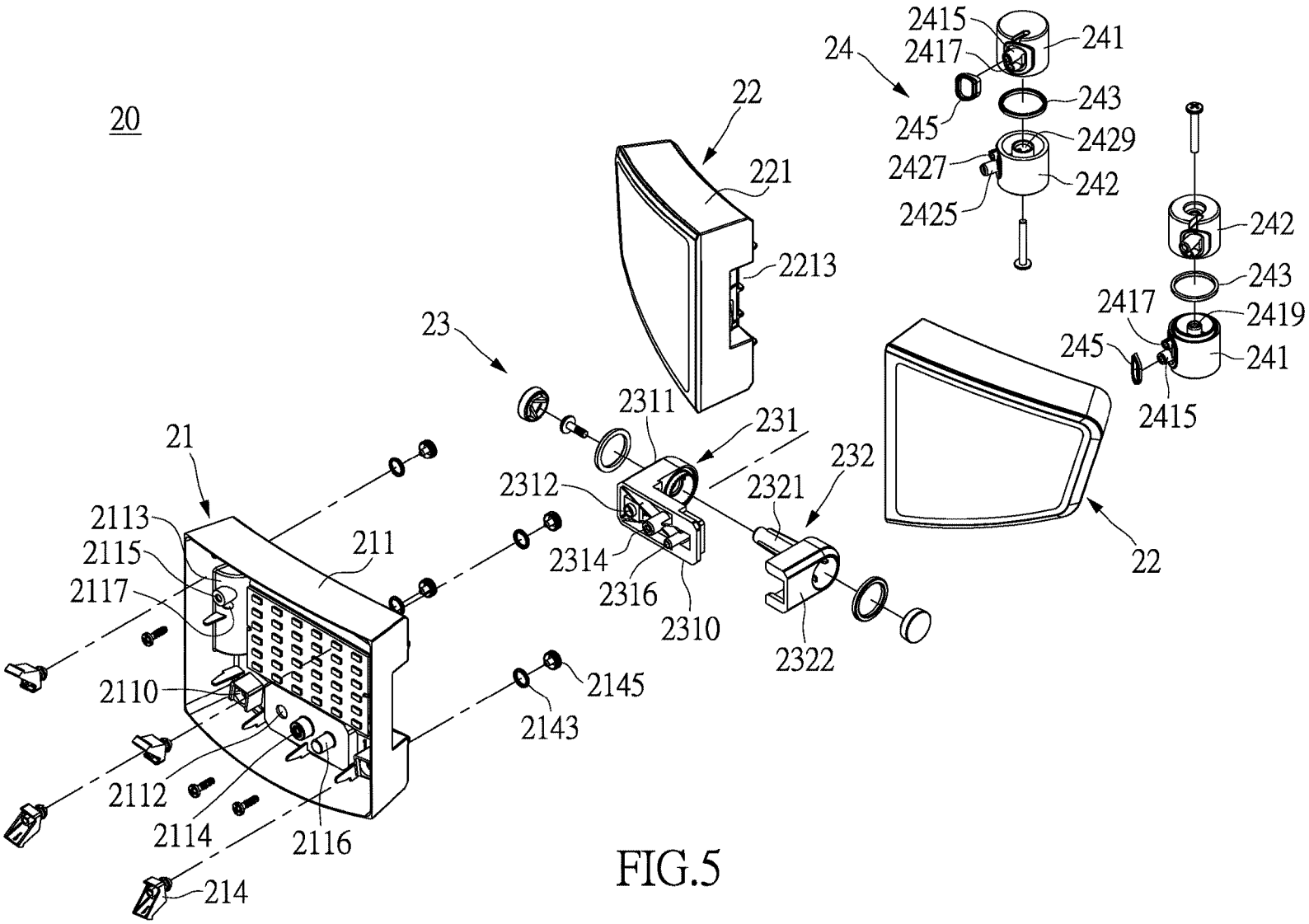
FIG. 5 is an exploded perspective view of an adapter module and a hinge module of the instant disclosure.
Figure 6:
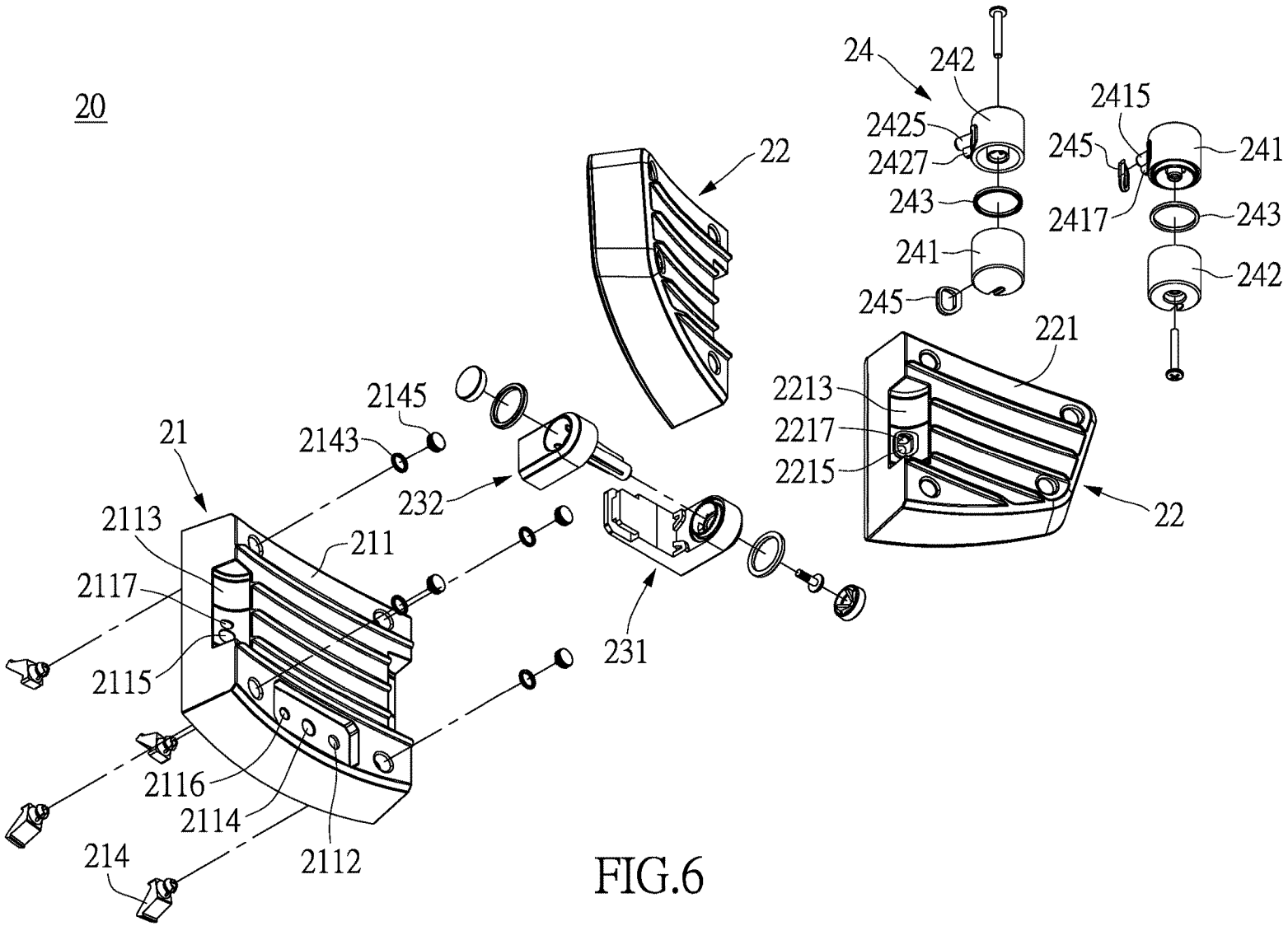
FIG. 6 is another exploded perspective view of the adapter module and the hinge module of the instant disclosure.

Refer to FIG. 5 and FIG. 6. The front lamp 21 has two sides and each side has a concave-shaped first receiving section 2113. The illumination lamp 22 also has a lamp holder 221. One side of the illumination lamp 22, which is closed to the front lamp 21, has a concave-shaped second receiving section 2213. The second receiving section 2213 is arranged at a vertical side of the lamp holder 221 and close to the first receiving section 2113. The first sleeve 241 has a part received and fixed in the first receiving section 2113. The second sleeve 242 has a part received and fixed in the second receiving section 2213. A water-proof washer 245 is arranged between the first sleeve 241 and the first receiving section 2113, and another water-proof washer 245 is arranged between the second sleeve 242 and the second receiving section 2213.

Refer to FIG. 6. The first receiving section 2113 is similar as the second receiving section 2213. The first receiving section 2113 and the second receiving section 2213 respectively have a screw part 2115, 2215 and a wiring hole 2117, 2217. The first sleeve 241 and the second sleeve 242 respectively have a fixing rod 2415, 2425, a wire tube 2417, 2427 for wires (not shown) passing through, and a central pipe 2419, 2429 connecting the wire tube 2417, 2427. The fixing rod 2415 (2425) passes through and screws to the screw part 2115 (2215, refer to FIG. 6). The wire tube 2417 (2427) passes through the wiring hole 2117 (2217, refer to FIG. 6). The hinge module 24 further has a water-proof ring 243 disposed between the first sleeve 241 and the second sleeve 242. Therefore, wire (not shown) can be orderly passed through the wiring hole 2117 of the front lamp 21, the wire tube 2417 of the first sleeve 241, the central pipe 2419 of the first sleeve 241, then enter the central pipe 2429 of the second sleeve 242, and the wire tube 2427 of the second sleeve 242, finally entering into the illumination lamp 22.

The adapter module 23 has an L-shaped fixing seat 231, and an L-shaped axle seat 232 connected to the fixing seat 231. The fixing seat 231 has a basal-portion 2310 fixed on the housing 211 of the front lamp 21, and a first lateral arm 2311 outwardly extended from the basal-portion 2310. The axle seat 232 has a second lateral arm 2322 and a connecting axle 2321 extended from the second lateral arm 2322 toward the fixing seat 231.

The housing 211 of the front lamp 21 has a wire central-hole 2112, a first receiving section 2114 and a positioning tube 2116. The basal-portion 2310 of the fixing seat 231 has a main wire slot 2312, a fixing rod 2314 and a positioning rod 2316. The main wire slot 2312 is communicated with the first lateral arm 2311 corresponding to the wire central-hole 2112. The fixing rod 2314 is inserted and fixed in the first receiving section 2114. The positioning rod 2316 is inserted in the positioning tube 2116. Therefore, wires (not shown) can pass through the wire central-hole 2112 of the front lamp 21, the main wire slot 2312 of the adapter module 23, then the first lateral arm 2311 of the adapter module 23, and finally pass through the pivotal portion 14 of the base seat 10 entering into the base seat 10.

Figure 7:
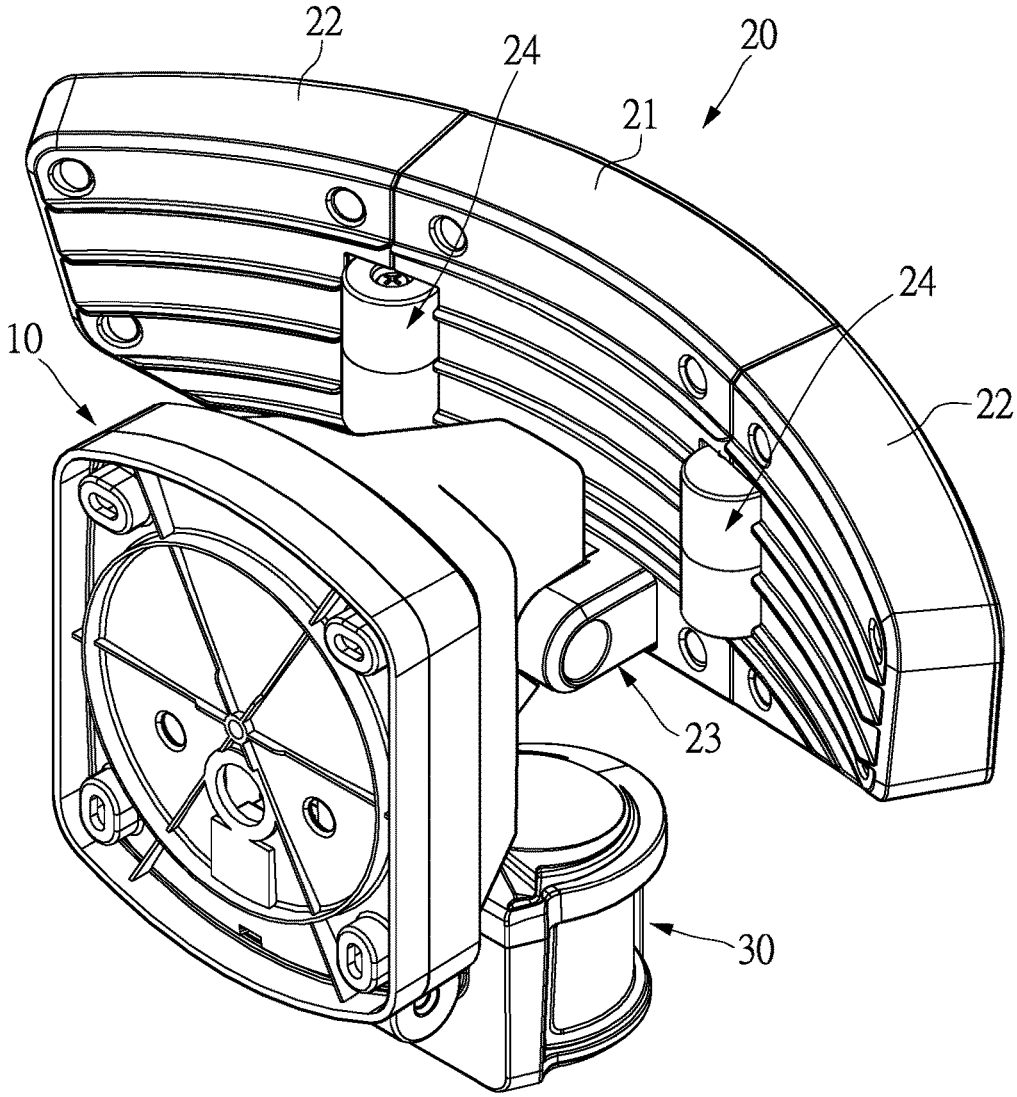
FIG. 7 is an assembled view of the motion sensing lighting device of the instant disclosure.
Figure 8:
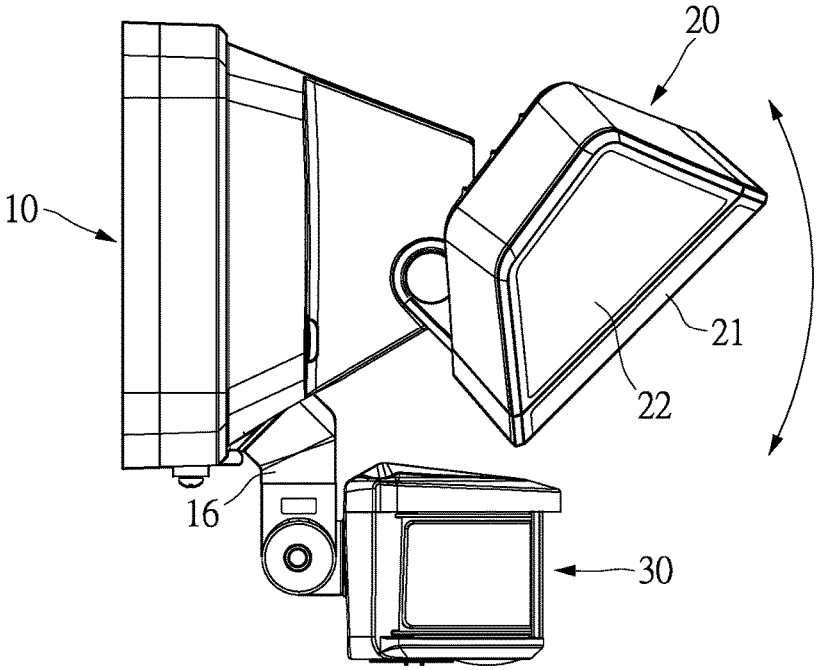
FIG. 8 is a side view of the motion sensing lighting device in an adjustable condition of the instant disclosure.
Figure 9:
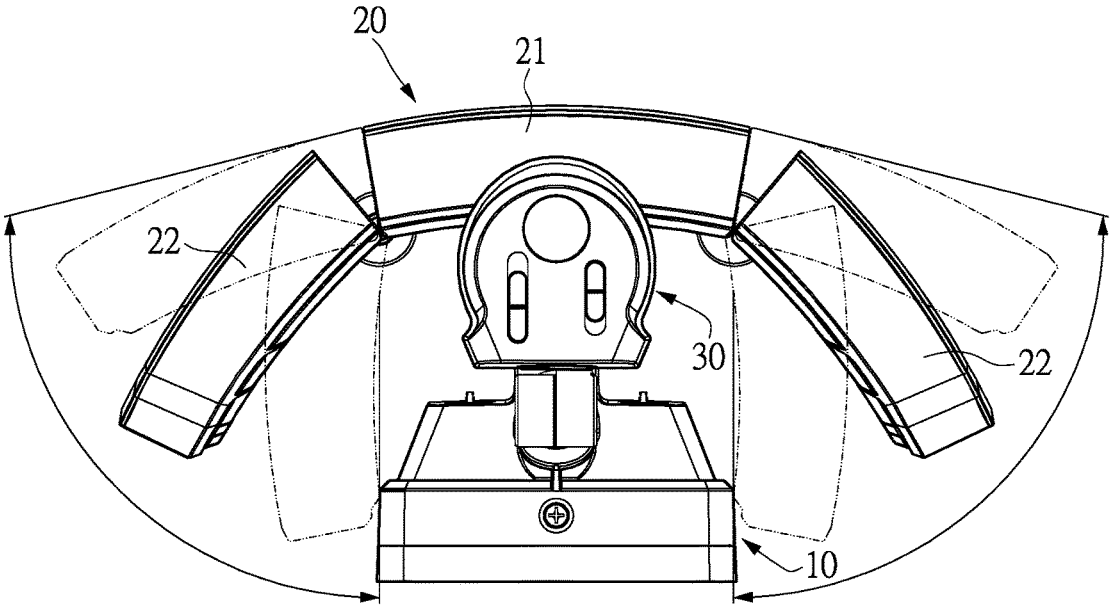
FIG. 9 is a bottom view of the motion sensing lighting device in the adjustable condition of the instant disclosure.

Refer to FIG. 7, which is an assembled view of the present disclosure. Through the above-mentioned structure, the front lamp 21 can be adjusted to change its lighting angle of pitch along a central axis of the adapter module 23, as shown in FIG. 8. The illumination lamps 22 are arranged at two sides of the front lamp 21, and the illuminating assembly 20 substantially is arc shaped. When the illumination lamps 22 are closed to the front lamp 21 without rotation, the illumination intensity can be increased and the lighting angle is widened. If it is required, the illumination lamps 22 can be adjusted toward two sides to widen the lighting angle. As shown in FIG. 9, the illumination lamps 22 at two sides of the present disclosure can be bent about 90 degrees. According to the condition of FIG. 8, the two illumination lamps 22 at two sides can be bent more close to the pivotal portion 14, even over 90 degrees.

Figure 10:
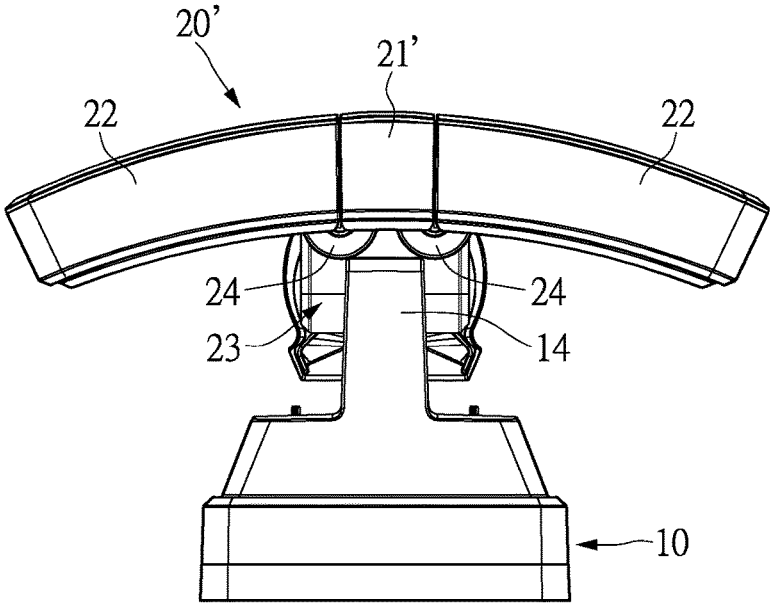
FIG. 10 is a top view of the motion sensing lighting device of another embodiment of the instant disclosure.

Refer to FIG. 10, which is a top view of the motion sensing lighting device of another embodiment according to the present disclosure. Different from the above embodiment, this embodiment has an illuminating assembly 20'. The illuminating assembly 20' has a different central component 21'. The width of the central component 21' is smaller than the width of the front lamp 21 of the previous embodiment, which could connect the two illumination lamps 22 at two sides but without a lighting function.

Figure 11:
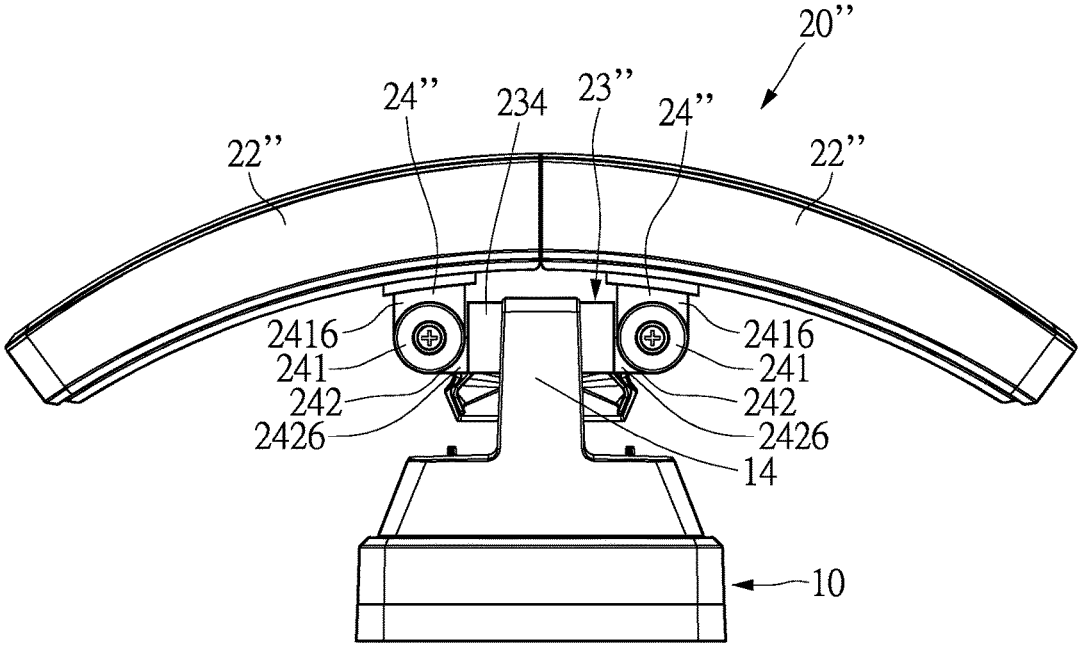
FIG. 11 is a top view of the motion sensing lighting device of a third embodiment of the instant disclosure.

Refer to FIG. 11, which is a top view of a motion sensing lighting device of a third embodiment according to the present disclosure. Different from the above embodiment, this embodiment has a hinge module 24" which is protruded from a rear surface of the illuminating assembly 20". This embodiment has two illumination lamps 22" for lighting. Besides, this embodiment has an adapter module 23" which has a rotation shaft 234 rotatably disposed on a pivotal portion 14 of the base seat 10. The rotation shaft 234 has two ends protruded outside two sides of the pivotal portion 14 respectively. The two ends of the adapter module 23" respectively have a hinge module 24". The illumination lamp 22" is rotatably connected to the pair of hinge modules 24". Each hinge module 24" has a first sleeve 241 and a second sleeve 242. The first sleeve 241 has a linking rod 2416 extended to fix with the back of the illumination lamp 22". The second sleeve 242, which is mostly hidden and covered by the first sleeve 241 in FIG. 11, rotatably overlaps the first sleeve 241, and both can be connected by the structure as shown in FIG. 5 which is not described again here. The second sleeve 242 has a linking rod 2426 extended to fix with two ends of the rotation shaft 234 of the adapter module 23".

Figure 12:
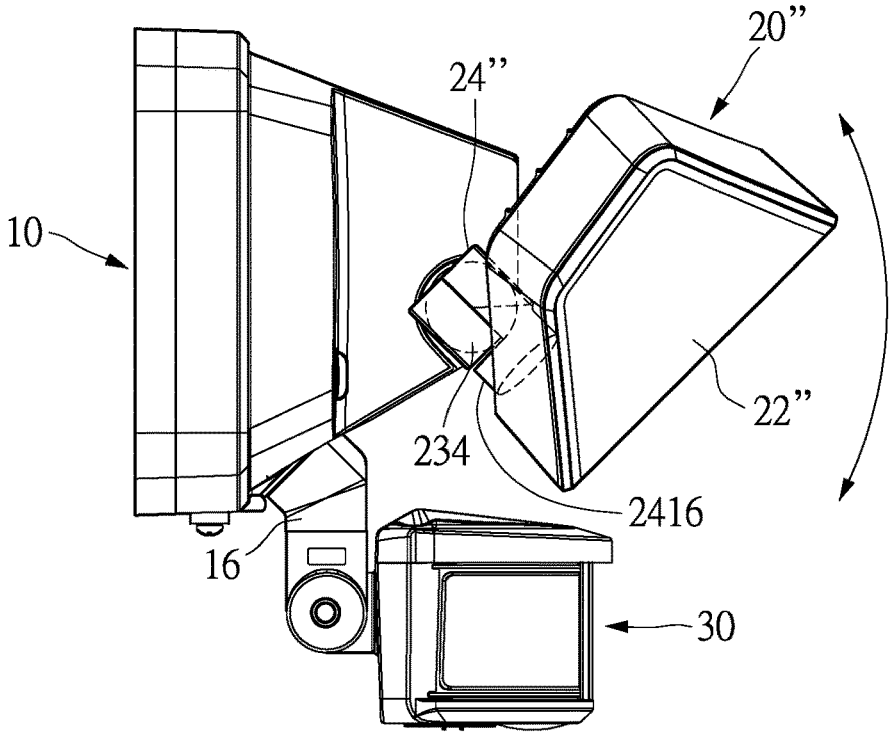
FIG. 12 is a side view of the motion sensing lighting device of a third embodiment after adjustment of the instant disclosure.
Figure 13:
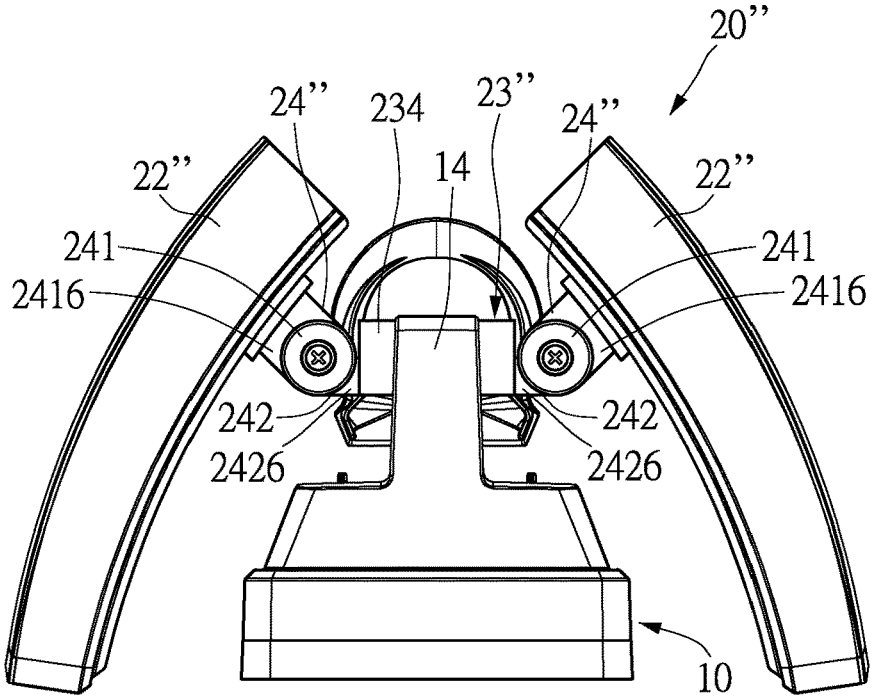
FIG. 13 is a top view of the motion sensing lighting device of a third embodiment after adjustment of the instant disclosure.
Figure 14:
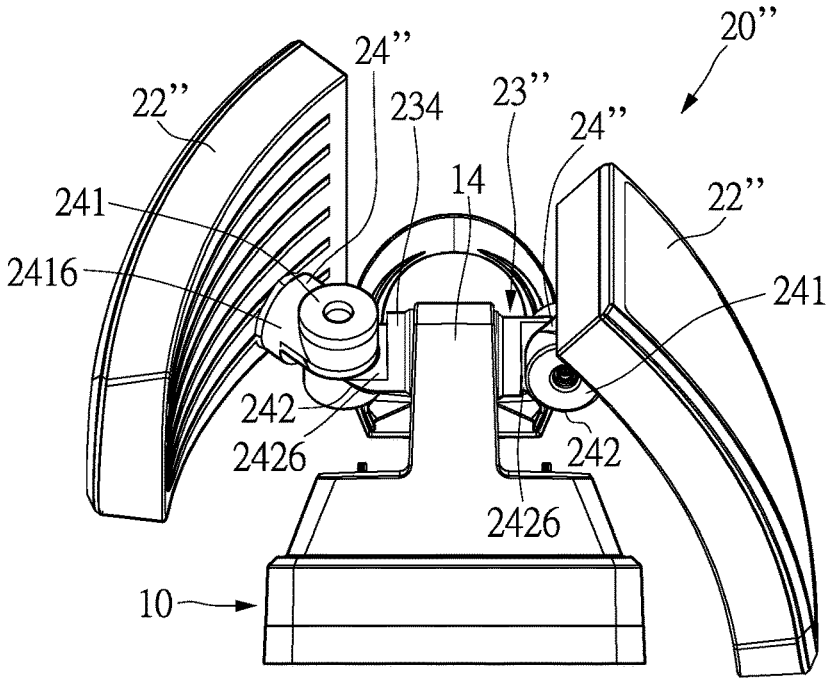
FIG. 14 is a top view of the motion sensing lighting device of a third embodiment in another adjusted condition of the instant disclosure.

A supplementary description of this embodiment can have two adapter modules 23". The two adapter modules 23" are rotatably connected to the pivotal portion 14 of the base seat 10, respectively, so that the two hinge modules 24" and the two illumination lamps 22" can independently rotate relative to the pivotal portion 14. In other words, two sides of the pivotal portion 14 can be equipped with one adapter module 23", respectively. The pair of adapter modules 23" are respectively protruded from two sides of the pivotal portion 14. Each of the adapter modules 23" has one end which is connected with the hinge module 24", and the hinge module 24" is connected with the illumination lamp 22". Therefore, the illumination lamps 22" can be rotated relative to the pivotal portion 14 toward different directions, as shown in FIG. 14. In other words, the number of the adapter module can be at least one. Therefore, the rotation shaft of this embodiment is moved to the base seat 10, and the two illumination lamps 22" can be drawn close to a center of the base seat 10. Even the front lamp can be omitted. The lighting angle of this embodiment is shown as in FIG. 12 and FIG. 13.

Figure 15:
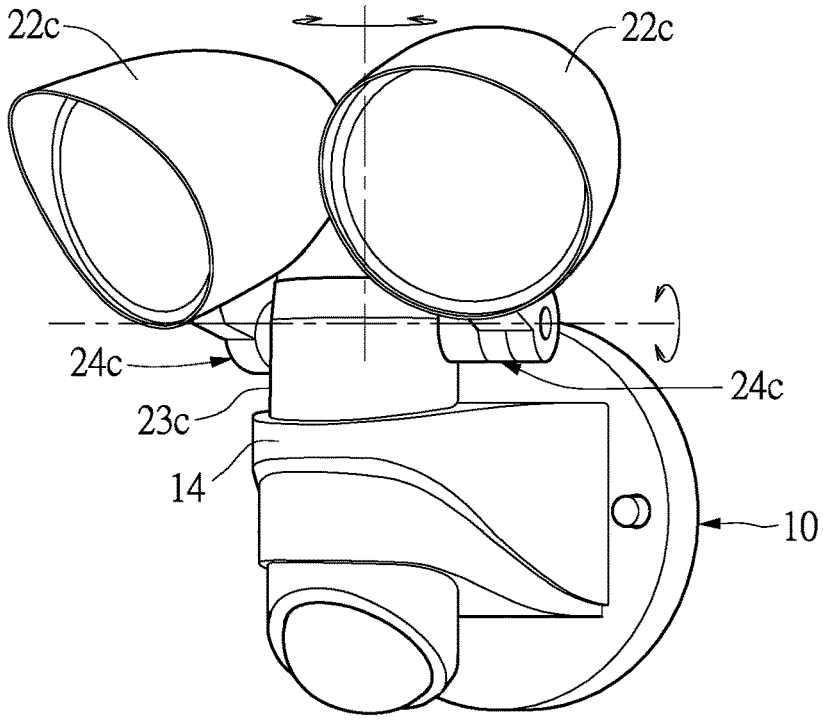
FIG. 15 is a perspective view of view of the motion sensing lighting device of a fourth embodiment of the instant disclosure.

Refer to FIG. 15, which is a perspective view of the motion sensing lighting device of a fourth embodiment of this instant disclosure. This embodiment has a base seat 10. An adapter module 23*c* is rotatably connected to the pivotal portion 14 of the base seat 10 along an axis perpendicular to the ground (refer to the vertical axis as shown in FIG. 15). Two sides of the adapter module 23*c* respectively have a hinge module 24*c*. The hinge module 24*c* is rotatably connected to the adapter module 23*c* along an axis horizontal with the ground (refer to the horizontal axis as shown in FIG. 15). A pair of illumination lamps 22*c* are respectively connected to the pair of hinge modules 24*c*. The pivotal axis of the hinge module 24*c* is perpendicular to the pivotal axis of the adapter module 23*c*.

To sum up, the advantages of the present disclosure are as follows. The illuminating assembly 20 is pivotally connected to the base seat 10 by a single pivotal axis, so that the lighting angle can be adjusted. In addition, the illuminating assembly 20 has illumination lamps 22 which are pivotally connected to the sides of the front lamp 21, so that it can fulfill a demand of enlarging the wide lighting angle. This embodiment can conveniently adjust the lighting angle according requirements. Moreover, this embodiment provides a new assembly manner through the linking unit 214, which can reduce the number of screws, so that the assembly process is more quick and convenient, with a water-proofing function.

The description above only illustrates specific embodiments and examples of the instant disclosure. The instant disclosure should therefore cover various modifications and variations made to the herein-described structure and operations of the instant disclosure, provided they fall within the scope of the instant disclosure as defined in the following appended claims.

What is claimed is:

1. A motion sensing lighting device, comprising:

a base seat, having a pivotal portion; and an illuminating assembly, having at least one adapter module rotatably connected to the pivotal portion, and a pair of illumination lamps, wherein the adapter module is pivotally connected to the pivotal portion; the pair of illumination lamps are rotatably arranged at two sides of the adapter module;

wherein the adapter module is extended forward to connect a central component, a hinge module is arranged between one side of the illumination lamp and one side of the central component, the pair of illumination lamps are rotatably connected to two sides of the central component by the hinge module, respectively.

2. The motion sensing lighting device as claimed in claim 1, wherein the hinge module has a first sleeve, and a second sleeve rotatably overlapping the first sleeve, wherein the first sleeve has a part fixed to one side of the central component, the second sleeve has a part fixed to one side of the illumination lamp.

3. The motion sensing lighting device as claimed in claim 1, wherein the central component is a front lamp.

4. The motion sensing lighting device as claimed in claim 3, wherein the front lamp includes a shallow-dish housing, a lighting unit fixed in the housing, a hollow-shaped reflector, a retaining frame for fixing the reflector in the housing, a sealing ring surrounding a periphery of the retaining frame, and a lampshade fixed to the retaining frame and covering the reflector, wherein the front lamp further includes a plurality of linking units, wherein the housing has a plurality of engaging holes corresponding to the linking units, the retaining frame has a plurality of fastening rings protruded from an inner edge thereof toward the housing, wherein the fastening rings are corresponding to the engaging holes, each of the linking units has a wedging part and a fastening part, the wedging part of the linking unit is engaged with the engaging holes of the housing, the fastening part of the linking unit is hooked with the fastening ring of the retaining frame.

5. The motion sensing lighting device as claimed in claim 4, wherein the inner edge of the retaining frame further has an inner rim, and a plurality of snap taps protruded toward the housing, the inner rim blocks the reflector, the snap taps are contacted against a periphery of the reflector.

6. The motion sensing lighting device as claimed in claim 4, wherein the linking unit further has a water-proof ring arranged on the wedging part and connected with a periphery of the engaging hole, and an ornamental cover is fixed at an outer end of the wedging part.

7. The motion sensing lighting device as claimed in claim 4, wherein the adapter module has an L-shaped fixing seat, and an L-shaped axle seat connected to the fixing seat, the fixing seat has a basal-portion fixed to the housing of the front lamp, and a first lateral arm extended outward from the basal-portion; the axle seat has a second lateral arm and a connecting axle extended from the second lateral arm toward the fixing seat.

8. The motion sensing lighting device as claimed in claim 7, wherein the housing has a wire central-hole, a first receiving section and a positioning tube, wherein the basal-portion of the fixing seat has a main wire slot connected to the first lateral arm corresponding to the wire central-hole, a fixing rod inserted and fixed in the first receiving section, and a positioning rod inserted in the positioning tube.

9. The motion sensing lighting device as claimed in claim 1, wherein the hinge module has a first sleeve, and a second sleeve rotatably overlapping the first sleeve, wherein the side of the central component includes a first receiving section in a concave-shape, the side of the illumination lamp includes a second receiving section in a concave-shape contiguous to the first receiving section, wherein a part of the first sleeve is received and fixed in the first receiving section, and a part of the second sleeve is received and fixed in the second receiving section.

10. The motion sensing lighting device as claimed in claim 9, wherein the first receiving section and the second receiving section respectively have a screw part and a wiring hole, the first sleeve and the second sleeve respectively have a fixing rod, a wire tube for wire passing therethrough, and a central pipe connected to the wire tube, the fixing rod passes through and screwed with the screw part, the wire tube passes through the wiring hole, wherein the hinge module further has a water-proof ring disposed between the first sleeve and the second sleeve.

11. The motion sensing lighting device as claimed in claim 1, wherein a central axis of the adapter module is perpendicular to a central axis of the hinge module.

12. The motion sensing lighting device as claimed in claim 1, further comprising a sensing component, wherein the base seat has a connecting axle arranged under the pivotal portion, the sensing component is rotatably connected to the connecting axle and selectively to switch on the illuminating assembly.

13. The motion sensing lighting device as claimed in claim 1, wherein the adapter module and the pivotal portion are rotatably connected by a hinge or a ball joint connection.

14. A motion sensing lighting device, comprising:

a base seat, having a pivotal portion; and an illuminating assembly, having at least one adapter module rotatably connected to the pivotal portion, and a pair of illumination lamps, wherein the adapter module is pivotally connected to the pivotal portion; the pair of illumination lamps are rotatably arranged at two sides of the adapter module;

wherein there are two adapter modules, the pivotal portion is rotatably connected with at least one of the adapter modules, each of the adapter modules is mounted with a hinge module at one end thereof, and the hinge module is connected to the illumination lamp;

wherein the hinge module includes a first sleeve and a second sleeve rotatably overlapping the first sleeve, wherein the first sleeve is fixedly connected to one side of the illumination lamp, the second sleeve fixedly connected to a rotation shaft of the adapter module.

15. The motion sensing lighting device as claimed in claim 14, wherein the pivotal portion is rotatably connected with the two adapter modules.

16. The motion sensing lighting device as claimed in claim 14, wherein one of the adapter modules is rotatably connected with another one of the adapter modules.

17. A motion sensing lighting device, comprising:

a base seat, having a pivotal portion; and an illuminating assembly, having at least one adapter module rotatably connected to the pivotal portion, and a pair of illumination lamps, wherein the adapter module is pivotally connected to the pivotal portion; the pair of illumination lamps are rotatably arranged at two sides of the adapter module;

wherein the adapter module is extended forward to connect a central component, a hinge module is arranged between one side of the illumination lamp and one side of the central component, the pair of illumination lamps are rotatably connected to two sides of the central component by the hinge module, respectively;

wherein the hinge module has a first sleeve, and a second sleeve rotatably overlapping the first sleeve, wherein the first sleeve has a part fixed to one side of the central component, the second sleeve has a part fixed to one side of the illumination lamp;

wherein the central component is a front lamp;

wherein the adapter module and the pivotal portion are rotatably connected by a ball joint connection.

* * * * *